US011059697B2

(12) United States Patent
Zhou

(10) Patent No.: US 11,059,697 B2
(45) Date of Patent: Jul. 13, 2021

(54) BRAKE FORCE VERIFICATION OF AN ELEVATOR BRAKE

(71) Applicant: Inventio AG, Hergiswil (CH)

(72) Inventor: Joe Zhou, Shanghai (CN)

(73) Assignee: INVENTIO AG, Hergiswil NW (CH)

( * ) Notice: Subject to any disclaimer, the term of this patent is extended or adjusted under 35 U.S.C. 154(b) by 436 days.

(21) Appl. No.: 15/564,284

(22) PCT Filed: Apr. 7, 2016

(86) PCT No.: PCT/EP2016/057552
§ 371 (c)(1),
(2) Date: Oct. 4, 2017

(87) PCT Pub. No.: WO2016/162391
PCT Pub. Date: Oct. 13, 2016

(65) Prior Publication Data

US 2018/0134517 A1 May 17, 2018

(30) Foreign Application Priority Data

Apr. 7, 2015 (EP) ..... 15162684

(51) Int. Cl.
*B66B 5/00* (2006.01)
*B66B 1/32* (2006.01)
*B66B 1/34* (2006.01)

(52) U.S. Cl.
CPC ..... *B66B 5/0037* (2013.01); *B66B 1/32* (2013.01); *B66B 1/3453* (2013.01); *B66B 1/3461* (2013.01); *B66B 5/0025* (2013.01); *B66B 5/0031* (2013.01)

(58) Field of Classification Search
USPC ..... 187/393
See application file for complete search history.

(56) References Cited

U.S. PATENT DOCUMENTS

| | | | | |
|---|---|---|---|---|
| 4,987,977 | A * | 1/1991 | Nomura | B66B 1/32 187/288 |
| 5,076,399 | A * | 12/1991 | Horbruegger | B66B 1/304 187/293 |
| 9,791,009 | B2 * | 10/2017 | Hubbard | B66B 5/0037 |
| 2012/0217100 | A1 * | 8/2012 | Spirgi | B66B 5/0025 187/393 |

FOREIGN PATENT DOCUMENTS

| | | | |
|---|---|---|---|
| CN | 2164038 | Y | 5/1994 |
| CN | 1871172 | A | 11/2006 |
| CN | 101224831 | A | 7/2008 |
| CN | 104247249 | A | 12/2014 |
| EP | 2537790 | A1 | 12/2012 |
| JP | 2005001823 | A | 1/2005 |
| WO | 2005066057 | A2 | 7/2005 |
| WO | 2007094777 | A2 | 8/2007 |
| WO | 2012072517 | A1 | 6/2012 |

* cited by examiner

*Primary Examiner* — Christopher Uhlir
(74) *Attorney, Agent, or Firm* — William J. Clemens; Shumaker, Loop & Kendrick, LLP

(57) ABSTRACT

A method for verifying the brake force of an electromagnetic elevator brake includes the steps of closing the brake, supplying electrical current to the brake up to a preset verification level and determining whether there has been any movement of the elevator car being braked.

19 Claims, 3 Drawing Sheets

BRAKE FORCE VERIFICATION OF AN ELEVATOR BRAKE

FIELD

The present invention relates to elevators and, more particularly, to a method for operating elevators including a procedure for testing elevator brakes.

BACKGROUND

A conventional traction elevator typically comprises a car, a counterweight and traction means such as a rope, cable or belt interconnecting the car and the counterweight. The traction means passes around and engages with a traction sheave which is driven by a motor. The motor and the traction sheave rotate concurrently to drive the traction means, and thereby the interconnected car and counterweight, along an elevator hoistway. At least one brake is employed in association with the motor or the traction sheave to stop the elevator and to keep the elevator stationary within the hoistway. A controller supervises movement of the elevator in response to travel requests or calls input by passengers.

The brakes must satisfy strict regulations. For example, both the ASME A17.1-2000 code in the United States and European Standard EN 81-1:1998 state that the elevator brake must be capable of stopping the motor when the elevator car is travelling downward at rated speed and with the rated load plus 25%.

Furthermore, the elevator brake is typically installed in two sets so that if one of the brake sets is in anyway faulty, the other brake set still develops sufficient braking force to slow down an elevator car travelling at rated speed and with rated load.

Given the vital nature of the elevator brake, it is important that it is tested periodically. WO-A2-2005/066057 describes a method for testing the condition of the brakes of an elevator. In an initial calibration step of the method, a test weight is applied to the drive machine of the elevator and a first torque required for driving the elevator car in the upward direction is measured. Subsequently, the test weight is removed and at least one of the brakes or brake sets of the elevator is closed. Next, the empty elevator car is driven in the upward direction with the force of the aforesaid first torque and a check is carried out to detect movement of the elevator car. If movement of the elevator car is detected, then the aforesaid at least one brake of the elevator is regarded as defective.

A similar test method is disclosed in WO-A2-2007/094777 except that instead of using a test weight for calibration, a test torque is somehow preset and stored in an undisclosed way within the controller. With at least one of the brakes applied, the preset test torque is applied by the motor to move the empty elevator car. Any movement of the car is determined by either a position encoder or a hoistway limit switch. As before, if movement of the elevator car is observed, then the aforesaid at least one brake of the elevator is regarded as defective.

In both of the above test procedures, if a faulty brake has been detected the elevator is disabled and is no longer able to fulfil passengers travel requests. The elevator remains out of commission until the effected brake is replaced.

WO-A1-2012/072517 provides an alternative test procedure in which, while the brake is closed, the motor torque is progressively increased until the car moves. A value indicative of the motor torque at which the car moves is registered and compared with a reference value, and the degree to which the registered value exceeds the reference value is determined. The method can automatically determine whether or not the brake fulfils the regulatory loading conditions. If the registered value is less than the reference value, then the brake has failed. Alternatively, the brake is judged to have passed if the registered value is greater than or equal to the reference value. If the brake has passed, the method includes the additional step of determining the degree to which the registered value exceeds the reference value. Accordingly, if the registered value exceeds the reference value by less than a predetermined margin a maintenance request can be sent automatically to a remote monitoring center. The advantage of this arrangement is that maintenance of the elevator can be carried out proactively rather than reactively as in WO-A2-2005/066057 and WO-A2-2007/094777 where the maintenance center is only aware of an issue with a specific elevator after the brake has failed and the elevator has been automatically taken out of commission. If the brake of a specific elevator has only passed by a predetermined factor e.g. 10%, then the installation can send a signal indicating this fact to a remote monitoring center which in turn can generate a preventative maintenance order for elevator personnel to replace the brake before it actually fails.

A feature common to all of the brake test procedures discussed above is that they require the application of substantial motor torque against the closed brake to determine whether the brake satisfies the regulatory conditions. Not only do the tests lead to wear of the brake linings but, more importantly, the electrical current supplied to the motor windings in order to produce the required torque under these test conditions is drastically greater than that required during normal elevator operation. This together with the frequency at which the brake test is carried out will understandably lead to deterioration of the windings within the motor which in turn will negatively impact on the lifespan of the motor.

SUMMARY

An objective of the present invention is to overcome the disadvantages of the brake test procedures outlined in the prior art above.

Accordingly, the invention provides a method for operating an elevator having a car driven by a motor and at least one electromagnetic brake to stop the car. The method comprises the steps of closing a brake, supplying electrical current to the brake up to a preset verification level, and determining whether there has been any movement. Such movement, for example that of an elevator car or a drive shaft moving the car, can be detected by an encoder or other movement sensor.

In contrast to the test procedures summarized above with respect to the prior art, in the present method the brake test is performed without the need to supply electrical current to the motor windings. Accordingly, the test can be carried out without deterioration to the windings or lifespan of the motor.

The preset verification current level can represent or simulate the regulatory loading conditions which the brake must withstand and hence the method can automatically determine whether or not the brake fulfils the regulatory loading conditions. If motion is detected, the brake is determined to have a fault and a fault report can be sent to a remote monitoring center, e.g. via a modem and transponder. Otherwise, the test ends and the elevator can be returned back to normal operation.

Preferably, the method further comprises the step of determining whether there has been any movement after closing the brake but before supplying current to the brake. If such movement is detected, indicating a serious brake failure, the elevator can be taken out of commission immediately and a brake failure notification can be sent automatically to the remote monitoring center. The remote monitoring center in turn can generate a reactive maintenance order for elevator personnel to replace the defective brake.

The preset verification current level can be determined by a calibration process wherein a test weight is loaded into the elevator car, one of the brakes is opened, and the current supplied to the other brake is gradually increased until movement is detected and a value representative of the current that caused movement is measured and stored as the verification value. This procedure can be repeated for all other brakes.

The test weight can be selected to simulate the regulatory loading conditions which the brake must withstand. Preferably, the test weight is selected to simulate a load of at least 125% of the rated load of the car.

DESCRIPTION OF THE DRAWINGS

The invention itself, as well as other features and advantages thereof, are best understood by reference to the detailed description, which follows, when read in conjunction with the accompanying drawings, wherein.

DETAILED DESCRIPTION

Figure 1:
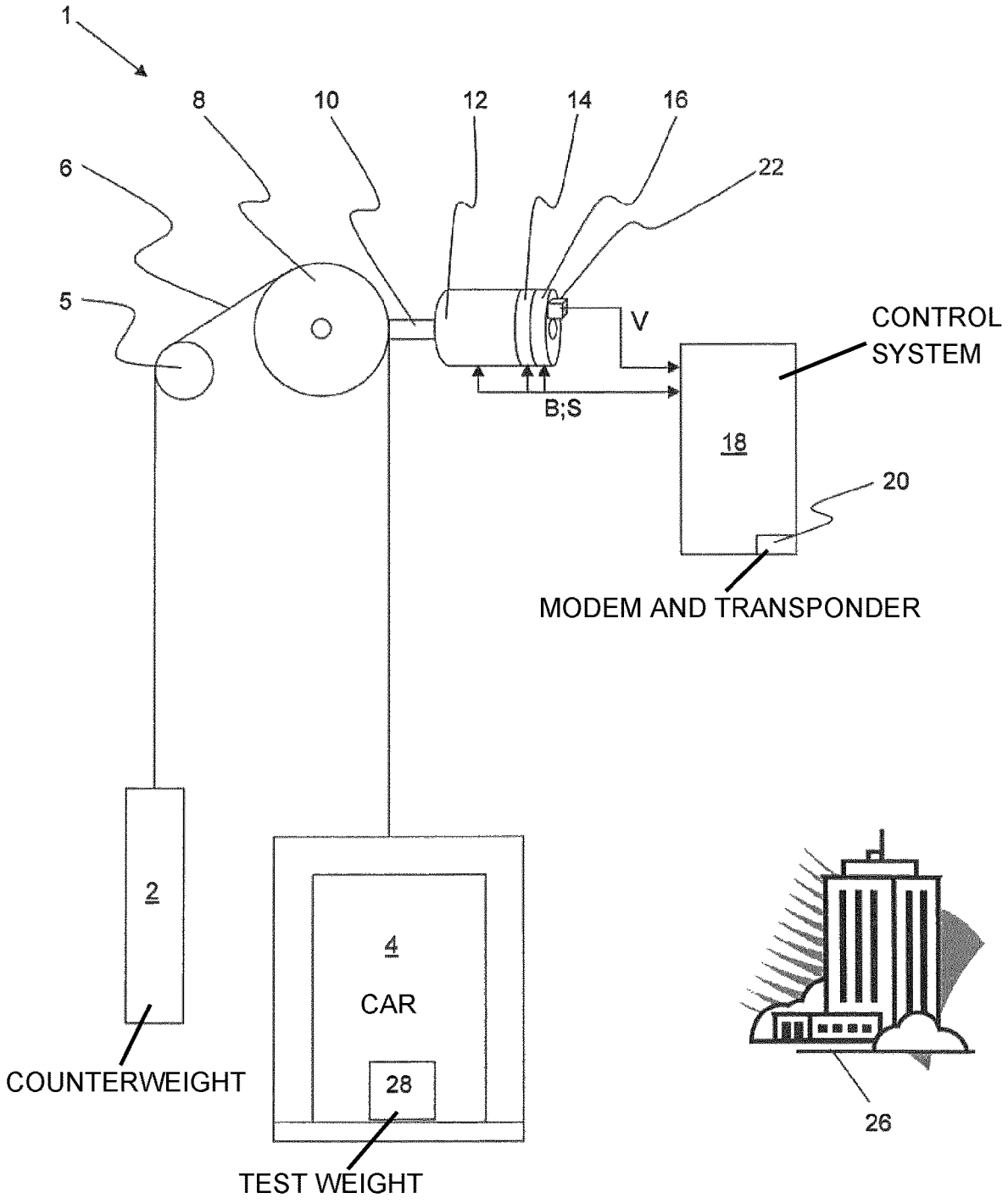
FIG. 1 (PRIOR ART)
FIG. 1 is a schematic illustration of a typical elevator installation.

A typical elevator installation 1 for use with the method according to the invention is shown in FIG. 1. The installation 1 is generally defined by a hoistway bound by walls within a building wherein a counterweight 2 and car 4 are movable in opposing directions along guide rails. Suitable traction means 6, such as a rope or belt, supports and interconnects the counterweight 2 and the car 4. In the present embodiment the weight of the counterweight 2 is equal to the weight of the car 4 plus 40% of the rated load which can be accommodated within the car 4. The traction means 6 is fastened to the counterweight 2 at one end, passed over a deflecting pulley 5 positioned in the upper region of the hoistway, passed through a traction sheave 8 also located in the upper region of the hoistway, and fastened to the elevator car 4. Naturally, the skilled person will easily appreciate other roping arrangements are equally possible.

The traction sheave 8 is driven via a drive shaft 10 by a motor 12 and braked by at least one elevator brake 14;16. The use of at least two brake sets is compulsory in most jurisdictions (see, for example, European Standard EN81-1:1998 12.4.2.1). Accordingly, the present example utilizes two independent, electro-mechanical brakes 14 and 16. Each of the brakes 14,16 includes a spring-biased brake armature 36 releasable against a corresponding disc 24 mounted to the drive shaft 10 of the motor 12. Alternatively, the brake armatures could be arranged to act on a brake drum mounted to the drive shaft 10 of the motor 12 as in WO-A2-2007/094777.

Actuation of the motor 12 and release of the brakes 14,16 is controlled and regulated by command signals B from a control system 18. Additionally, signals S representing the status of the motor 12 and the brakes 14,16 are continually fed back to the control system 18. Movement of the drive shaft 10 and thereby the elevator car 4 is monitored by an encoder 22 mounted on brake 16. A signal V from the encoder 22 is fed to the control system 18 permitting it to determine travel parameters of the car 4 such as position, speed and acceleration.

The control system 18 incorporates a modem and transponder 20 permitting it to communicate with a remote monitoring center 26. Such communication can be wirelessly over a commercial cellular network, through a conventional telephone network or by means of dedicated line.

Figure 2:
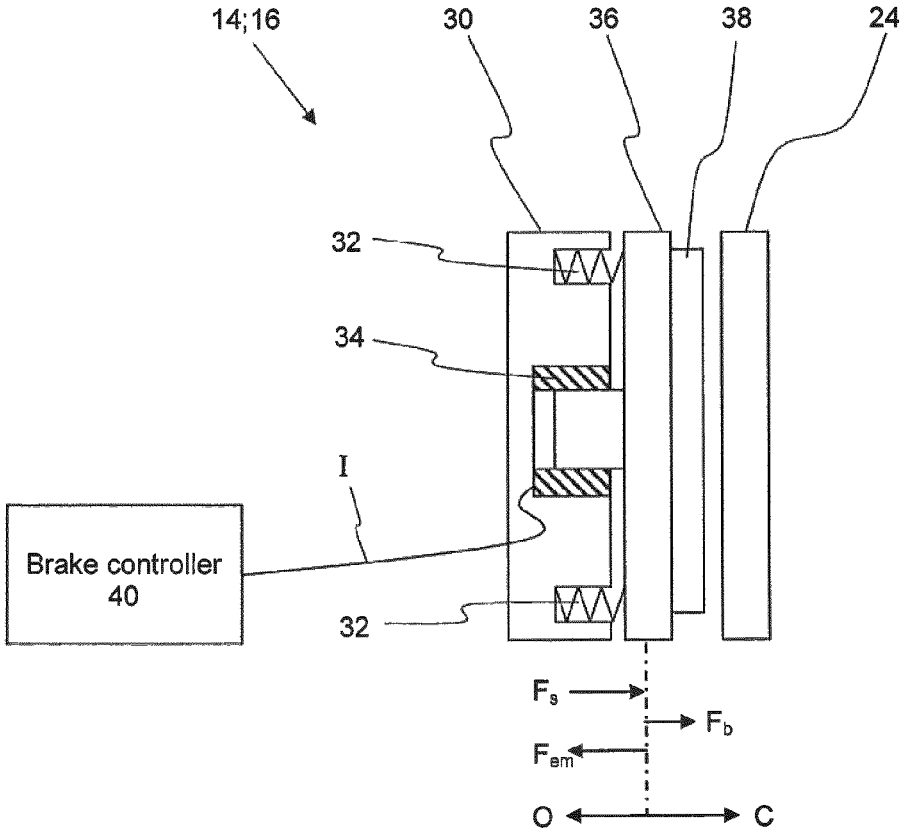
FIG. 2 (PRIOR ART)
FIG. 2 is a schematic illustrating the main components of the electro-mechanical brakes of FIG. 1.

FIG. 2 is a schematic illustrating the main components of the electro-mechanical brakes 14 and 16 of FIG. 1.

Each brake 14;16 includes a brake controller 40, an actuator 30 and an armature 36. The brake controller 40, as shown, is an independent element but it could equally be incorporated within the control system 18.

The actuator 30 houses one or more compression springs 32 which are arranged to bias the armature 36 towards the brake disc 24 in brake closing direction C with a spring force $F_s$. Additionally, an electromagnet 34 is arranged within the actuator 30. The electromagnet 34, when supplied by current I from the brake controller 40, exerts an electromagnetic force $F_{ern}$ on the armature 36 in the brake opening direction O to counteract the spring force $F_s$.

During initial commissioning of the elevator installation 1 a calibration process is conducted wherein a test weight 28 is loaded into the elevator car 4, one of the brakes 14;16 is opened, and the current I supplied to the other brake 14;16 is gradually increased until movement of the car 4 is detected by the encoder 22 and a value representative of the current that caused the car 4 to move is measured and stored as a verification value $I_{ver}$. This procedure is then repeated for the other brake 14;16.

The test weight 28 is carefully selected to correspond to the regulatory loading conditions for which the brake must be tested. In the present example, if the brakes 14,16 are required to hold a car containing 25% more than the rated load, i.e. 125% of rated load, then the brake force $F_b$ required from the brakes 14,16 is 85% of rated load since the counterweight 2 already balances 40% rated load (125%−40%=85%). In order to simulate this situation, the test weight 28 is selected to equal 125% of the rated load.

Preferably, the calibration process is conducted with the elevator car 4 positioned at the lowermost landing of the hoistway. Firstly, this is generally the most convenient location for bringing the test weight 28 into the building and subsequently loading it into the car 4. More importantly though, with the elevator car 4 in this position, the traction means 6 is imbalanced across the traction sheave 8 with the substantial majority of its weight acting on the car side of the traction sheave 8. Accordingly, the brake verification current $I_{ver}$ not only takes into account the required test loading conditions as outlined above but additionally supports the imbalance of the traction means 6 across the traction sheave 8. On the contrary, if the calibration stage was conducted with the elevator car 4 positioned at the uppermost landing of the hoistway, the substantial majority of the weight of the traction means 6 would act on the counterweight side of the traction sheave 8 and would detract from the measured and stored verification value $I_{ver}$. Accordingly, such a reference value would not meet the loading conditions for which the brake must be tested.

Although the calibration process as outlined above is conducted on the specific elevator site, it will be easily appreciated that the process can alternatively be conducted in the factory which manufactures the brake or assembles the elevator drive.

Figure 3:
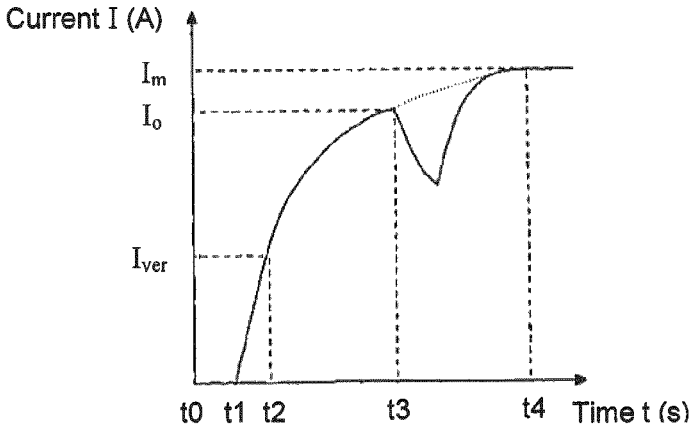
FIG. 3 (PRIOR ART)
FIG. 3 is a graphical representation of electromagnetic current versus time illustrating the operation of the electro-mechanical brake of FIGS. 1 and 2.

FIG. 3 is a graphical representation of electromagnetic current I versus time t to illustrate the operation of the electro-mechanical brake 14;16 of FIGS. 1 and 2. When current I is withdrawn from the electromagnet 34, as represented at time t0 in the graph, the spring force $F_s$ moves the armature 36 in the closing direction C so that a brake lining 38 mounted to the armature 36 frictionally engages with the brake disc 24 to decelerate a rotating disc 24 or, if the disc 24 is already motionless, hold it stationary. In this situation the braking force $F_b$ equals spring force $F_s$ ($F_b$=$F_e$).

As current I is supplied and gradually increased to the electromagnet 34 from time t1, it exerts an increasing electromagnetic force $F_{em}$ on the armature 36. At time t2, the current is at the verification level $I_{ver}$ and resultant braking force $F_b$ equals the regulatory loading conditions, which in this case corresponds to 125% of the rated load. The current I is continually increased further to time t3. During this time period t1 to t3, although the brake 14;16 will still engage with the disc 24, the resultant braking force $F_b$ will gradually decrease since $F_b$=$F_s$− $F_{em}$.

At time t3, when the current I has reached its brake opening value $I_o$, the spring and electromagnetic forces are at equilibrium. Immediately thereafter the electromagnetic force $F_{em}$ exceeds the opposing spring force $F_s$ and the armature 36 commences movement in the opening direction O and the brake lining 38 disengages from the disc 24 at which point $F_b$=0.

Although the brake controller 40 continues to increase the current I supplied to the electromagnet 34 as indicated by the dashed line between times t3 to t4, back e.m.f. induced into the electromagnet 34 by movement of the armature 36 in the opening direction O causes a net reduction in the electromagnet 34 current as shown by the full line in the FIG. 3. Accordingly, the armature 36 continues to move in the opening direction O during the interval from time t3 to t4 when it is maintained in the fully open condition by current $I_m$.

Figure 4:
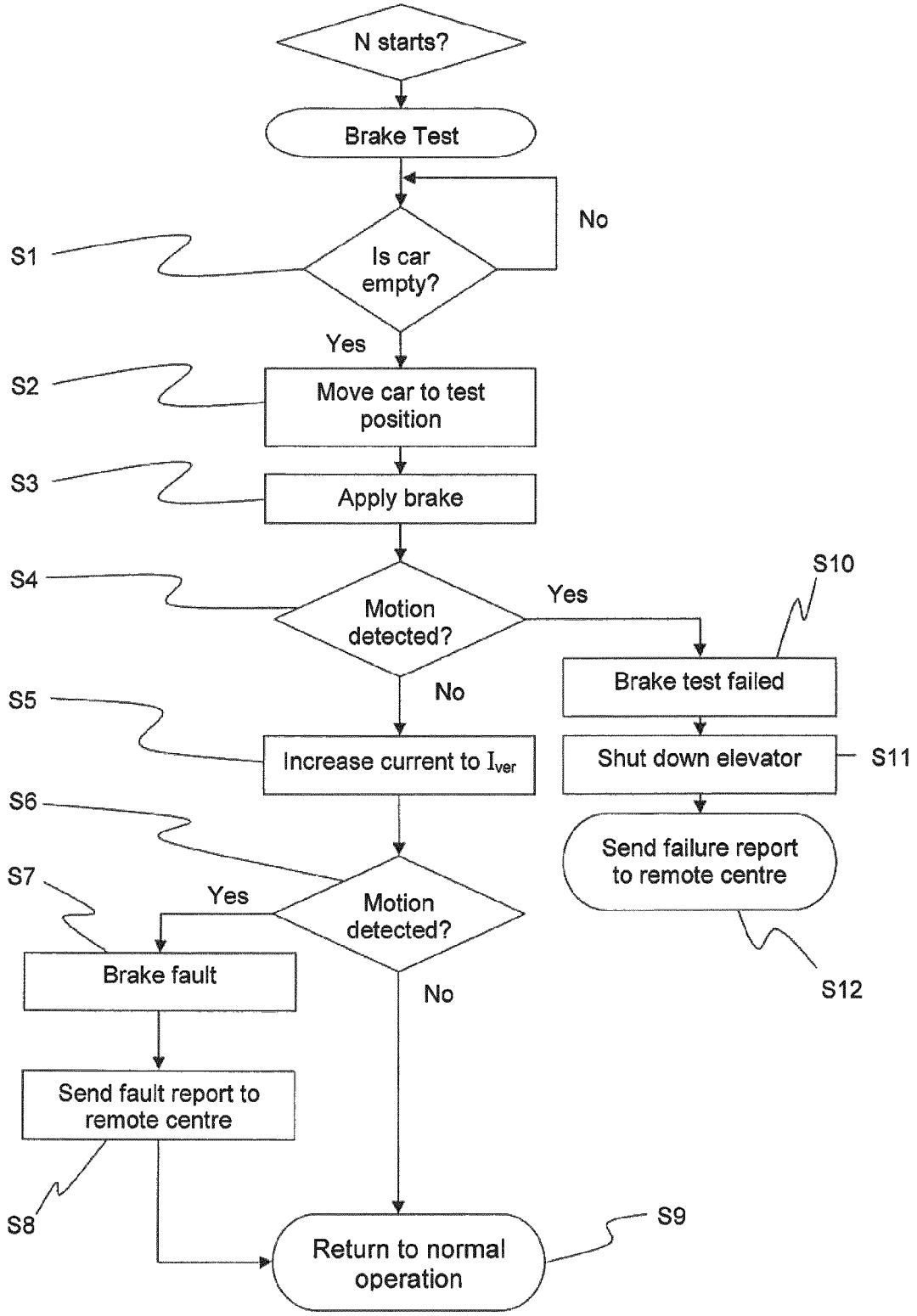
FIG. 4 is a flowchart illustrating method steps for operating an elevator.

FIG. 4 is a flowchart illustrating method steps for operating an elevator. Each of the brakes 14,16 are tested at a defined frequency. In the present example, the defined frequency refers to the number trips N the elevator has performed since the last brake test. Alternatively, the defined frequency may refer to a predetermined time interval since the last brake test.

The first step S1 in the procedure is to ensure that the elevator car 4 is empty. The control system 18 generally receives signals indicative of car loading and door status from which it can determine whether the car 4 is empty.

When the car 4 is empty, the procedure brake test proceeds to a second step S2 in which the empty car 4 is moved to a dedicated test position within the hoistway. Preferably, the test position corresponds to the penultimate floor at the top of the building since in this position not only the counterweight 2 but also the majority of the weight of the tension means 6 counteracts the load of the empty car 4.

Next, in step S3 the brake 14;16 undergoing the test is closed or released so as to engage its associated brake disc 24. The control system 18 maintains the other brake 16;14 in an open or unengaged condition.

In step S4, any movement of the drive shaft 10 and thereby the elevator car 4 is detected by the encoder 22. If motion is detected, the brake 14;16 is determined to have failed the test in step S10 and subsequently the elevator 1 is shut down or taken out of commission in step S11 and a test report is sent to the remote monitoring center 26 in step S12 by the control system 18 via the modem and transponder 20. Typically the test report contains information indicating that the brake 14;16 undergoing the test has failed and the remote monitoring center 26 in turn can generate a reactive maintenance order for elevator personnel to replace the defective brake 14;16.

If no movement is detected by the encoder 22 in step S4, the procedure continues to step S5 in which the control system 18 commands the brake controller 40 to supply and gradually increase the current I to the electromagnet 34, as depicted in the time period t1 to t2 in FIG. 3, until it reaches the verification level $I_{ver}$ so as to simulate the regulatory loading conditions. Again in step S6, any movement of the drive shaft 10 and thereby the elevator car 4 is detected by the encoder 22. If motion is detected, the brake 14;16 is determined to have a fault in step S7 and a fault report is sent to the remote monitoring center 26 in step S8 by the control system 18 via the modem and transponder 20.

Otherwise, the test ends and the elevator 1 is returned back to normal operation in step S9.

The test can then be repeated for the other brake 16;14.

Although the method has been described with particular reference to traction elevators, the skilled person will readily appreciate that it can also be equally applied to other elevator systems, for example, self-climbing elevators with the motor attached to the car. Similarly, the method can be applied to elevators wherein the or each brake is mounted to the car so as to engage a guide rail.

If the elevator system is overcompensated, for example, when the weight of a compensation chain or travelling rope is greater than that of the traction means, the skilled person will recognize that the car positions for conducting the calibration process and for conducting the brake test should be reversed.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for testing an elevator brake of an elevator having a car driven by a motor and an electromagnetic brake to stop the car, the method comprising the steps of:

closing the brake to stop the car by removing supply of electrical current to the brake;

supplying electrical current to the brake increasing from zero up to a preset verification current level without supplying electrical current to windings of the motor throughout the testing of the brake;

determining whether there has been any movement of the car during the increase of the electrical current to the brake; and verifying that the brake meets a capability requirement when no movement of the car is detected during the increase of the electrical current to the brake.

2. The method according to claim 1 further comprising a step of determining that a brake fault has occurred in response to detected movement of the car.

3. The method according to claim 2 further comprising a step of sending a brake fault notification to a remote monitoring center in response to the determining the brake fault.

4. The method according to claim 1 further comprising a step of determining whether there has been any movement of the car after the closing of the brake but before the supplying current to the brake.

5. The method according to claim 4 further comprising a step of determining a failure of the brake in response to detected movement of the car after the closing of the brake but before the supplying current to the brake.

6. The method according to claim 5 further comprising a step of taking the elevator out of commission in response to determining failure of the brake.

7. The method according to claim 5 further comprising a step of sending a brake failure notification to a remote monitoring center in response to the determining the brake failure.

8. The method according to claim 7 further comprising a step of generating a maintenance order for elevator personnel in response to the determining the brake failure.

9. The method according to claim 1 wherein the preset verification current level is determined by a calibration process comprising the steps of closing the brake, loading a test weight into the car, increasing the current supplied to the brake until movement of the car is detected and storing a current value at which the movement is detected as the preset verification current level.

10. The method according to claim 9 wherein the test weight is selected to simulate regulatory loading conditions applicable to the elevator.

11. The method according to claim 9 wherein the test weight is selected to simulate a load of at least 125% of a rated load of the car.

12. A method for testing an elevator brake of an elevator having a car driven by a motor and an electromagnetic brake to stop the car, the method comprising the steps of:

closing the brake to stop the car by removing supply of electrical current to the brake;

supplying electrical current to the brake increasing from zero up to a preset verification current level without supplying electrical current to windings of the motor throughout the testing of the brake;

determining whether there has been any movement of the car during the increase of the electrical current to the brake;

verifying that the brake meets a capability requirement when no movement of the car is detected during the increase of the electrical current to the brake;

determining that a brake fault has occurred in response to detected movement of the car;

determining whether there has been any movement of the car after the closing of the brake but before the supplying current to the brake; and determining a failure of the brake in response to detected movement of the car after the closing of the brake but before the supplying current to the brake.

13. The method according to claim 12 further comprising a step of taking the elevator out of commission in response to determining the brake failure.

14. The method according to claim 13 further comprising a step of sending a brake failure notification to a remote monitoring center in response to the determining the brake failure.

15. The method according to claim 12 further comprising a step of sending a brake fault notification to a remote monitoring center in response to the determining the brake fault.

16. The method according to claim 12 further comprising a step of generating a maintenance order for elevator personnel in response to the determining the brake fault or the brake failure.

17. The method according to claim 12 wherein the preset verification current level is determined by a calibration process comprising the steps of closing the brake, loading a test weight into the car, increasing the current supplied to the brake until movement of the car is detected and storing a current value at which the movement is detected as the preset verification current level.

18. The method according to claim 17 wherein the test weight is selected to simulate regulatory loading conditions applicable to the elevator.

19. The method according to claim 17 wherein the test weight is selected to simulate a load of at least 125% of a rated load of the car.

* * * * *